US011674506B2

(12) United States Patent
Cleland et al.

(10) Patent No.: US 11,674,506 B2
(45) Date of Patent: Jun. 13, 2023

(54) GAS OPERATED FLUID PUMP WITH INPUT AND OUTPUT GAS VALVES

(71) Applicant: Cleland Sales Corporation, Los Angeles, CA (US)

(72) Inventors: James Cleland, Cypress, CA (US); Adam Cleland, Los Alamitos, CA (US)

(73) Assignee: Cleland Sales Corporation, Los Alamitos, CA (US)

( * ) Notice: Subject to any disclaimer, the term of this patent is extended or adjusted under 35 U.S.C. 154(b) by 750 days.

(21) Appl. No.: 16/576,660

(22) Filed: Sep. 19, 2019

(65) Prior Publication Data

US 2020/0088176 A1 Mar. 19, 2020

Related U.S. Application Data

(60) Provisional application No. 62/733,475, filed on Sep. 19, 2018.

(51) Int. Cl.

| | |
|---|---|
| ***F04B 13/00*** | (2006.01) |
| ***F04B 19/06*** | (2006.01) |
| ***F04B 15/02*** | (2006.01) |

(52) U.S. Cl.

CPC ..... *F04B 13/00* (2013.01); *F04B 15/02* (2013.01); *F04B 19/06* (2013.01); *F04B 2201/0601* (2013.01)

(58) Field of Classification Search

CPC ..... F04B 13/00; F04B 15/02; F04B 19/06; F04B 2201/0601

See application file for complete search history.

(56) References Cited

U.S. PATENT DOCUMENTS

| | | | | |
|---|---|---|---|---|
| 5,564,602 | A | 10/1996 | Cleland et al. | |
| 9,574,554 | B2 * | 2/2017 | Reed | F04B 43/0736 |
| 2009/0026220 | A1 * | 1/2009 | Ramnarine | F04B 13/00 222/77 |
| 2010/0264160 | A1 | 10/2010 | Simmonds et al. | |
| 2011/0049182 | A1 | 3/2011 | Smith et al. | |

* cited by examiner

*Primary Examiner* — P. Macade Nichols

(74) *Attorney, Agent, or Firm* — Fish IP Law, LLP

(57) ABSTRACT

A viscous fluid is dispensed precisely using a fluid pump, control valves configured to control both the air inlet and outlet of the fluid pump, an optional adjustable regulator further controlling the air outlet, and a control circuit that opens and closes the control valves. To further increase the precision, additional control valves can be used to control liquid inlet and outlet of the fluid pump.

20 Claims, 2 Drawing Sheets

GAS OPERATED FLUID PUMP WITH INPUT AND OUTPUT GAS VALVES

This application claims the benefit of priority to U.S. Provisional Patent Applications No. 62/733,475, filed on Sep. 19, 2018. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is fluid dispensing in the food industry.

BACKGROUND

The following background description includes information that may be useful in understanding the present invention. It is not an admission that any of the information provided herein is prior art or relevant to the presently claimed invention, or that any publication specifically or implicitly referenced is prior art.

There are several instances in the food industry in which viscous fluids need to be dispensed over distances of more than a few meters, in a precise manner. For example, a restaurant might have several flavoring dispensers that they use to flavor vanilla ice cream for milkshakes. The flavoring dispensed might well contain pieces of fruit, such as strawberry or blueberry, which are not readily dispensed over such distances, or in any sort of precise manner. And yet such dispensing is important to maintain consistent quality of the milkshakes, and consumers generally regard flavorings with gel and solid pieces as more flavorful, and generally of higher quality.

Of course, numerous fluid dispensing systems are known in the food industry, for example, soda dispenser, or beer dispenser, ice cream dispenser, and frozen yogurt dispenser. Commonly used systems include a gas pumps connected to a high-pressure gas source to pump the fluid. While dispensing a final product does not need to be highly precise, dispensing an ingredient (e.g., an ice cream favor) requires more precision. However, existing dispensing systems are not suitable for delivering a precise amount of fluid, due to lack of a precise controlling mechanism.

US Patent Application No. US20110049182A1 by Smith et al (hereinafter "Smith") teaches an apparatus for dispensing a beverage having separate pressure regulators to independently control pressure at a beverage source and also at a beverage pump, so that natural pressure of beverage is maintained as it travels from the source to a dispensing station. U.S. Pat. No. 5,564,602A to Cleland et al (hereinafter "Cleland") teaches a beer-dispensing apparatus that includes a heat exchanger to cool the beer. US Patent Application No. US20100264160A1 by Simmonds et al (hereinafter "Simmonds") teaches a dispensing system having individual electronic poppet control valves to control multiple fluid streams, so that multiple streams of draught beers can be dispensed from one faucet. However, none of these (Smith, Cleland or Simmonds) teaches how to dispense a viscous fluid over distances of more than a few meters, in a precise manner.

Thus, there is still a need for apparatus, systems and methods to dispense viscous fluids, over distances of more than a few meters, in a precise manner.

These publications are all incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

SUMMARY OF THE INVENTION

The inventive subject matter provides apparatus, systems and methods in which a viscous fluid is dispensed precisely using a fluid pump, at least two control valves to control an air inlet and outlet of the fluid pump, an optional adjustable regulator further controlling the air outlet, and a control circuit that opens and closes the control valves.

In preferred embodiments, a pneumatically operated fluid pump has an air inlet, an air outlet, a fluid inlet, and a fluid outlet. The flow of air into the air inlet is controlled by a first control valve, and flow of air out of the air outlet is controlled by a second control valve. A control circuit can open and close both the first and second control valves. Optionally, an adjustable regulator is fluidly coupled to and positioned downstream of the second control valve. In some embodiments, the system has a third control valve configured to control the liquid outlet, or a fourth control valve configured to control the liquid inlet, or both.

It turns out to be quite a surprising result that use of the dual or triple control mechanisms provides more accurate dispensing than when using only a single valve as in the prior art. Experimentation has shown that 10-15 ml of a viscous berry or fruit syrup, jam, jelly, or other flavoring can be dispensed with variance of no more than 1 ml, and more preferably with variance of no more than 0.5 ml. It is contemplated that the flavorings can be stored in a Bag in a Box (BiB).

In preferred embodiments, a timer that regulates a time delay between opening and closing the first and second control valves by sending electrical signals to the first and second solenoids, respectively. Contemplated time delay can be between 0.05 second to 1 second, and more preferably between 0.1 second to 0.5 second. The first and second control valves cooperate with the pump to repeatedly dispense the fluid with a variance of no more than 1 ml, preferably no more than 0.5 ml, and more preferably, no more than 0.1 ml. It is contemplated that fluid that can be precisely dispensed by the system has a viscosity of at least 5,000 cps, preferably at least 25,000 cps, and more preferably, at least 100,000 cps.

In some embodiments, the fluid dispensing system can dispense two different fluids by having two sets of dispensing systems describe above, controlled by a single control panel. Each set of dispensing system can be used to dispense a fluid, so that the test device can be used to deliver two separate fluids at the same time.

The inventive subject matter also includes a method of precisely dispensing a viscous fluid (e.g., syrup, flavoring or other fluid). Contemplated methods include the steps of, preferably in sequence, predetermining a volume of the fluid to be dispensed, providing a pneumatically operated fluid pump having an air inlet, an air outlet, a fluid inlet that receives a flow of the fluid, and a fluid outlet for passing the fluid to a dispenser, activating a first control valve to open the air outlet, activating a second control valve to open the air inlet, dispensing fluid, and closing the air outlet within one second of closing the air inlet to reliably deliver the predetermined volume. Opening and closing of the air inlet and air outlet valves is contemplated to be substantially simultaneous, although it is also contemplated that one might close up to a second or so before the other.

In preferred embodiments, the sequence of operation is as follows: a) open the fluid dispense valve, b) open the air inlet and outlet valves, c) dispense liquid, d) close the air inlet and outlet valves, and e) close the dispense valve. In especially preferred embodiments, the air outlet control valve is opened before the air inlet control valve, and the closed after the air inlet control valve. This sequence of operation advantageously aims to prevent pressure from building up in the system (i.e., to prevent spurting). Moreover, the air inlet and outlet valves are opened after the fluid inlet and outlet valves are opened, and when closing the system, the air inlet and outlet valves are closed first, before the fluid inlet and outlet valves are closed, so that pressure does not build up in the system. It is contemplated that the dispensed fluid has a variance of no more than 1 ml, more preferably 0.5 ml, or even more preferably 0.1 ml compared to the predetermined volume.

It is further contemplated that volume to be dispensed can be fine-tuned by adjusting a regulator fluidly positioned downstream of the second control valve. In some embodiments, after the system is fine tuned to deliver a set volume, a user can activate a control button or other distal from the pump. The switch triggers a timer, which then sends electric signals to 1) solenoids that operate the valves located at liquid inlet and/or outlet and 2) solenoids that operate valves located at both the air inlet and the air outlet of the fluid pump. It is contemplated that fine tuning can be accomplished by adjusting a regulator coupled to the air output of the second control valve. After a set time has expired, which might well be only a few seconds, the predetermined volume of fluid will have been dispensed, the solenoids and control valves will cooperate to automatically close the valves. Closing of the valves can be actively or passively operated by the solenoids.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
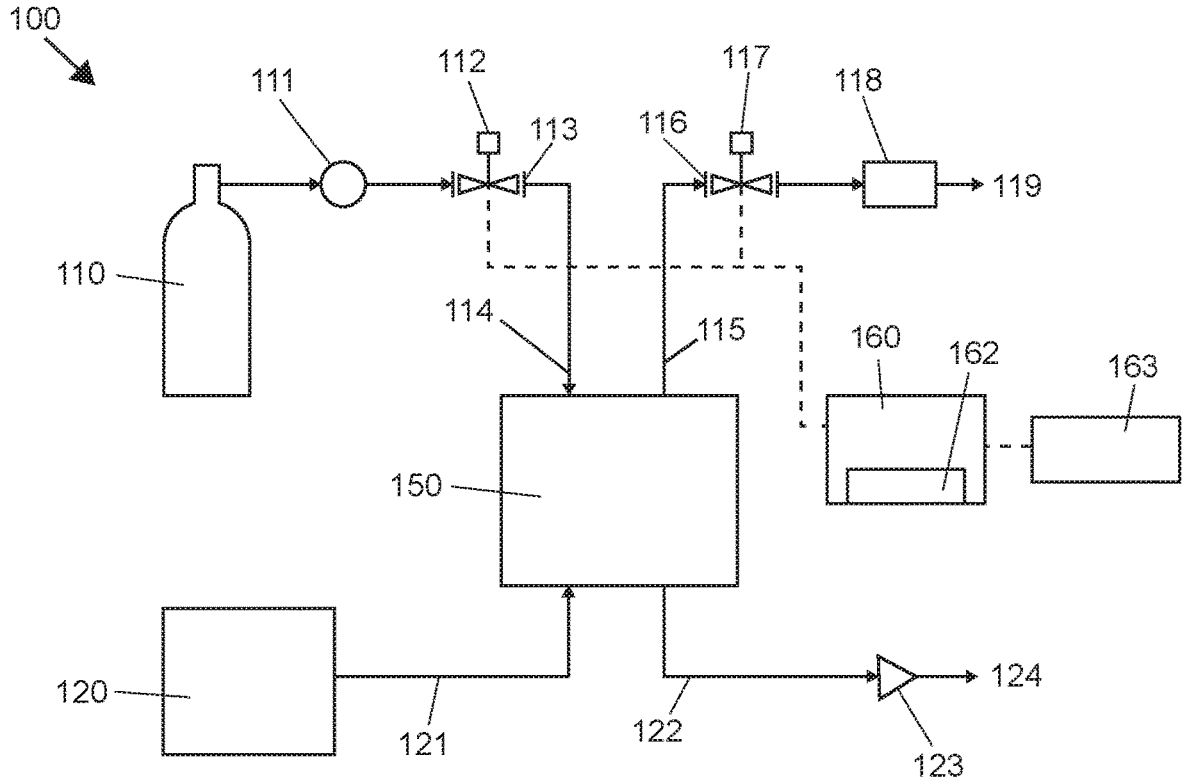
FIG. 1 is a schematic of an embodiment of the fluid dispensing system having two control valves.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

FIG. 1 shows a preferred embodiment of the fluid dispensing system 100. In FIG. 1, a pressured gas source (e.g., $CO_2$ tank) 110 provides compressed gas through a regulator 111 to an upstream solenoid 112 controlled air valve 113. Gas flows through the air line to an inlet 114 of the pump 150. It is contemplated that any suitable fluid pump can be utilized; however, positive displacement pumps are preferred. Unlike centrifugal or roto-dynamic pumps, positive displacement pumps can theoretically produce the same flow at a given speed (RPM) regardless of the discharge pressure or backflow, or discharge speed.

A speed or a stroke of the fluid pump is controlled by air regulators, preferably control valves. Contemplated control valves include electric valves (e.g., a solenoid valve) or mechanical valves (e.g., operated manually). Compressed air causes pump 150 to pump fluid from a fluid inlet 121 connected to a fluid supply 120, out through an outgoing fluid line 122 and then through a fluid dispensing unit having a dispense valve 123. Contemplated fluid dispensing units include nozzle (with a check valve), a faucet, or other types of suitable outlet for dispensing a fluid. Contemplated fluid supply 120 can be any liquid container, for example, a Bag in a Box (BiB).

Gas exiting the pump 150 travels along gas out line 115, through downstream air valve 116, which is operated by solenoid 117, and an optional fine-tuning valve 118 (preferably a needle valve). As used herein, a needle valve refers to a type of valve having a small port and a threaded, needle-shaped plunger, allowing precise regulation of flow. The needle valve can be adjusted by turning a screw. The fine-tuning valve 118 (i.e., an adjustable regulator) is preferably located downstream from the second control valve 117, but can also be located upstream of the control valve 117, or upstream or downstream of the first control valve 113.

Electrical control of solenoids 112 and 117 is accomplished by signals from a controller 160 having a timer circuit 162. The controller 160 can be controlled by a control panel 163 having multiple buttons controlling the solenoids 112 and 117. It is contemplated that other control mechanisms can be used, for example, manual control or wireless control. It is also contemplated a check valve (not shown) can be installed the liquid outgoing line 124, preferably near the outlet, so that the liquid can only flow in one direction.

A preferred sequence of operation of the fluid dispensing system 100 is as follows: a) open the fluid dispense valve 123, b) open the air inlet 113 and outlet 116 valves, c) dispense liquid, d) close the air inlet 113 and outlet 116 valves, and e) close the dispense valve 123. In especially preferred embodiments, the air outlet control valve 116 is opened before the air inlet control valve 113, and the closed after the air inlet control valve 113. This sequence of operation advantageously aims to prevent pressure from building up in the system (i.e., to prevent spurting). It is contemplated that the dispensed fluid has a variance of no more than 1 ml, more preferably 0.5 ml, or even more preferably 0.1 ml compared to the predetermined volume.

Figure 2:
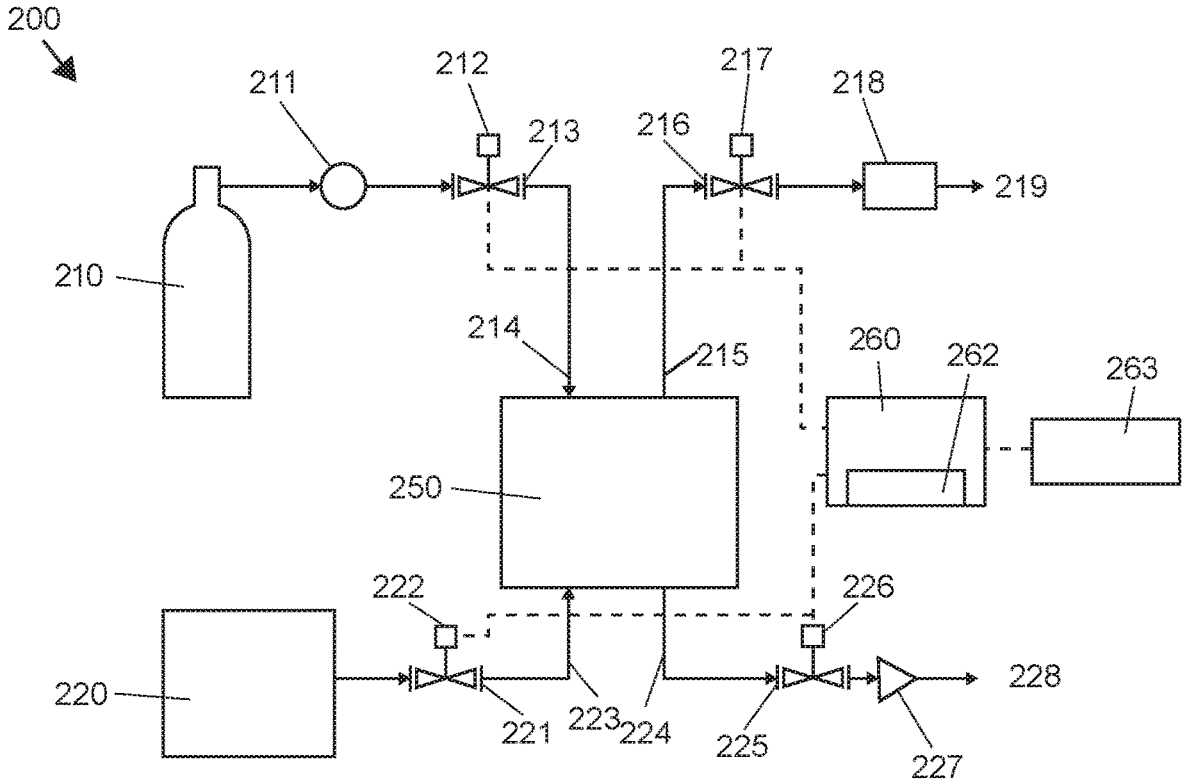
FIG. 2 is a schematic of another embodiment of the fluid dispensing system having four control valves.

FIG. 2 shows another embodiment of the fluid dispensing system 200, which is similar to the embodiment in FIG. 1, but with additional control valves installed. In FIG. 2, a third control valve 221 is installed on the fluid incoming line 223, and a fourth control valve 225 is installed on the fluid outgoing line 224. The additional valves provide further control over the liquid flow. Electrical control of control valves 221 and 225 can be accomplished by solenoids 222 and 226, respectively, both of which can be controlled from the control panel 160.

A preferred sequence of operation of the fluid dispensing system 200 is as follows: a) open the fluid dispense valve 227, b) open the air inlet 213 and outlet 216 valves, c) open the liquid inlet 221 and outlet 225 valves, d) dispense liquid, e) close the air inlet 113 and outlet 116 valves, e) close the liquid inlet 221 and outlet 225 valves, and f) close the dispense valve 123. In especially preferred embodiments, the air outlet control valve 216 is opened before the air inlet control valve 213, and the closed after the air inlet control valve 213. This sequence of operation advantageously aims to prevent pressure from building up in the system (i.e., to prevent spurting).

Figure 3:
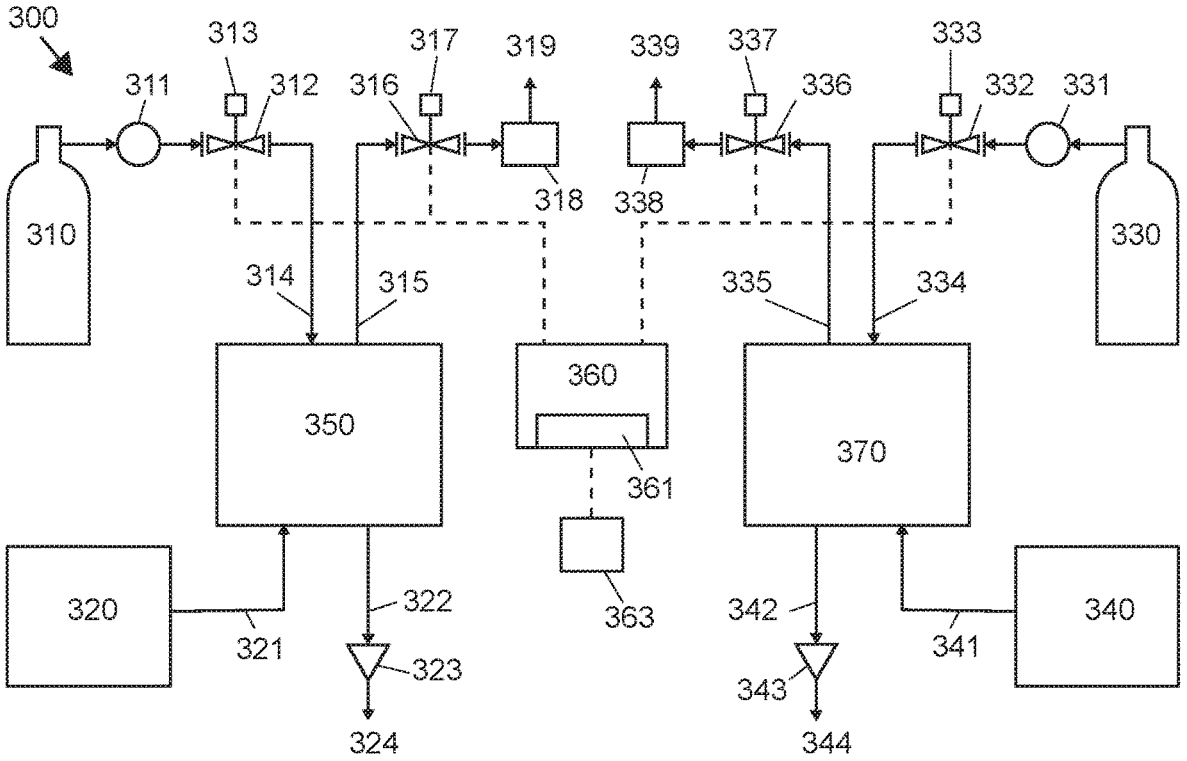
FIG. 3 is a schematic of an embodiment of the fluid dispensing system for dispensing two different liquids.

FIG. 3 shows an embodiment of the fluid dispensing system 300 capable of dispensing two different fluids. This fluid dispensing system 300 essentially combines two fluid dispensing systems 100 into one system 300, controlled by a single control panel 360. The system 300 has two sets of dispensing systems, including a first pump 350 and a second pump 370. Each set of dispensing system can be used to dispense a fluid, so that the dispensing system 300 can be used to deliver two separate fluids at the same time.

Figure 4:
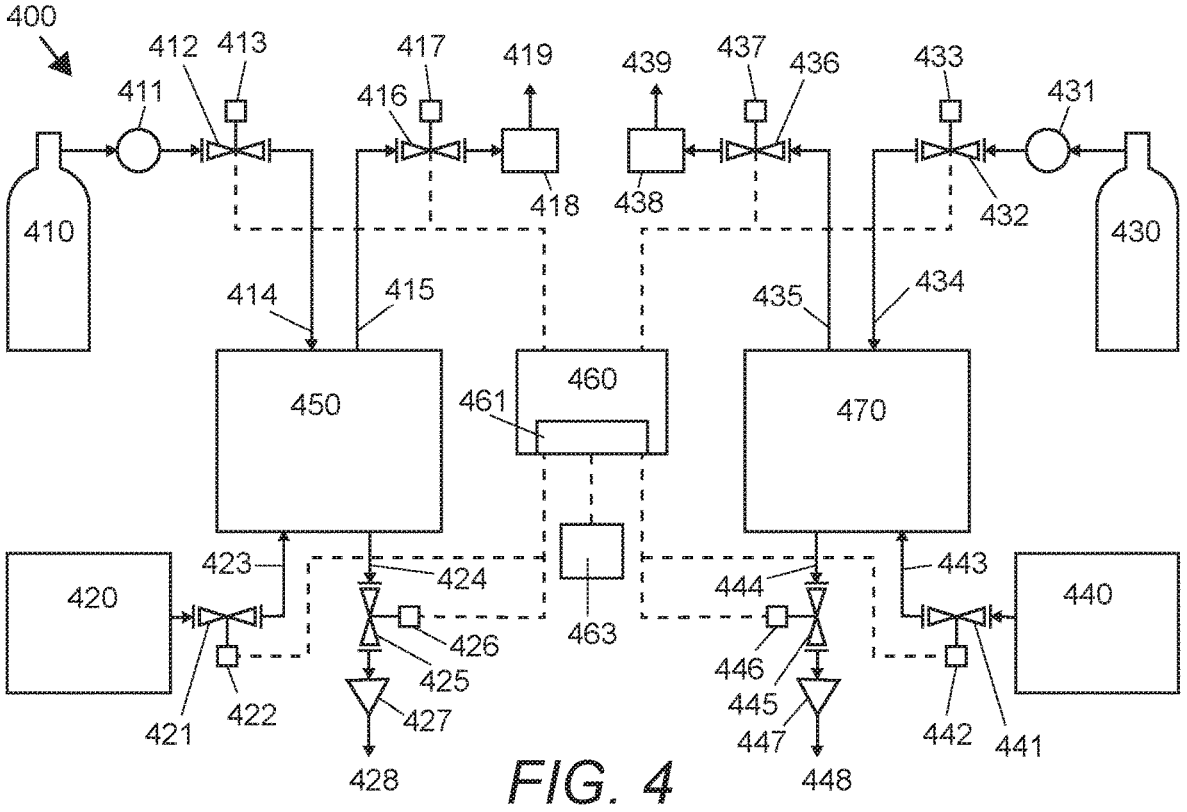
FIG. 4 is a schematic of another embodiment of the fluid dispensing system for dispensing two different liquids.

FIG. 4 shows another embodiment of the fluid dispensing system 400 capable of dispensing two different fluids. This fluid dispensing system 400 essentially combines two fluid dispensing systems 200 into one system 400, controlled by a single control panel 460. The system 400 has two sets of dispensing systems, including a first pump 450 and a second pump 470. Each set of dispensing system can be used to dispense a fluid, so that the dispensing system 400 can be used to deliver two separate fluids at the same time.

It is contemplated that the fluid to be dispensed by the devices according to teachings herein can be any liquid, a mixture of liquids, a mixture of a liquid and a gas, or a mixture of a liquid and a solid, or any combination thereof, including emulsions. However, the devices according to teachings herein have the greatest utility in circumstances where the fluid being dispensed is relatively viscous, with at least some gels and small solids. It is contemplated that a liquid having a viscosity between 0 and 250,000 centipoise (cps), as determined by a Brookfield rotational viscometer at STP (20° C. and atmospheric pressure) can be accurately dispensed in the current inventive subject matter. A chart of some common liquid food items and their approximate viscosity at room temperature (70° F.) is below:

Approximate Viscosities of Common Materials (At Room Temperature, 70° F.)

| Material | Viscosity in Centipoise |
|---|---|
| Water | 1 cps |
| Milk | 3 cps |
| Karo Syrup | 5,000 cps |
| Honey | 10,000 cps |
| Chocolate | 25,000 cps |
| Ketchup | 50,000 cps |
| Mustard | 70,000 cps |
| Sour Cream | 100,000 cps |
| Peanut Butter | 250,000 cps |

It is further contemplated that the fluid to be dispensed can have high or low viscosity, acidity, pressure, or temperature. It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A system for dispensing a fluid, comprising:

a pneumatically operated fluid pump having an air inlet, an air outlet, a fluid inlet, and a fluid outlet;

a first control valve configured to control a flow of air to the air inlet;

a second control valve configured to control the air outlet; and a control circuit that opens and closes both the first and second control valves.

2. The system of claim 1, further comprising an adjustable regulator fluidly coupled to and positioned downstream of the second control valve.

3. The system of claim 2, wherein the adjustable regulator is a needle valve.

4. The system of claim 1, further comprising a first solenoid that operates the first control valve, and a second solenoid that operates the second control valve.

5. The system of claim 4, further comprising a timer that regulates a time delay between opening and closing the first and second control valves by sending electrical signals to the first and second solenoids, respectively.

6. The system of claim 5, wherein the time delay is between 0.05 second to 1 second.

7. The system of claim 5, wherein the time delay is between 0.1 second to 0.5 second.

8. The system of claim 1, wherein the fluid has a viscosity of at least 5,000 cps.

9. The system of claim 8, wherein the first and second control valves cooperate with the pump to repeatedly dispense the fluid with a variance of no more than 0.1 ml.

10. The system of claim 1, wherein the fluid has a viscosity of at least 25,000 cps.

11. The system of claim 10, wherein the first and second control valves cooperate with the pump to repeatedly dispense the fluid with a variance of no more than 0.5 ml.

12. The system of claim 1, wherein the fluid has a viscosity of at least 100,000 cps.

13. The system of claim 12, wherein the first and second control valves cooperate with the pump to repeatedly dispense the fluid with a variance of no more than 1 ml.

14. The system of claim 1, further comprising a third control valve configured to control the liquid outlet.

15. The system of claim 1, further comprising a fourth control valve configured to control the liquid inlet.

16. A system for dispensing a first and a second fluid, comprising:

a first pneumatically operated fluid pump having a first air inlet, a first air outlet, a first fluid inlet, and a first fluid outlet;

a first control valve configured to control a flow of air to the first air inlet;

a second control valve configured to control the first air outlet;

a second pneumatically operated fluid pump having a second air inlet, a second air outlet, a first fluid inlet, and a first fluid outlet;

a third control valve configured to control a flow of air to the second air inlet;

a fourth control valve configured to control the second air outlet; and a control circuit that opens and closes the first, second, third, and fourth control valves;

wherein the first and second fluid can be dispensed simultaneously.

17. The system of claim 16, further comprising:

a fifth control valve configured to control a flow of a first liquid to the first liquid inlet;

a sixth control valve configured to control the first liquid outlet;

a seventh control valve configured to control a flow of a second liquid to the second liquid inlet;

an eighth control valve configured to control the second liquid outlet;

wherein the control circuit opens and closes the fifth, sixth, seventh, and eighth control valves.

18. A method of dispensing a fluid, comprising:

predetermining a volume of the fluid to be dispensed;

providing a pneumatically operated fluid pump having an air inlet, an air outlet, a fluid inlet that receives a flow of the fluid, and a fluid outlet for passing the fluid to a dispenser;

activating a first control valve to open and close the air inlet;

activating a second control valve to open and close the air outlet; and closing the air outlet within one second of the air inlet to reliably deliver the predetermined volume of the fluid with a variance of no more than 1 ml.

19. The method in claim 18, further comprising fine tuning the predetermined volume by adjusting a regulator fluidly positioned downstream of the second control valve.

20. The method in claim 18, wherein activating the second control valve proceeds activating the first control valve.

* * * * *